US008400213B2

(12) United States Patent
Sicard

(10) Patent No.: US 8,400,213 B2
(45) Date of Patent: Mar. 19, 2013

(54) COMPLEMENTARY BAND-GAP VOLTAGE REFERENCE CIRCUIT

(75) Inventor: Thierry Sicard, Tournefeuille (FR)

(73) Assignee: Freescale Semiconductor, Inc., Austin, TX (US)

( * ) Notice: Subject to any disclaimer, the term of this patent is extended or adjusted under 35 U.S.C. 154(b) by 109 days.

(21) Appl. No.: 13/122,321

(22) PCT Filed: Nov. 18, 2008

(86) PCT No.: PCT/IB2008/055646

§ 371 (c)(1),
(2), (4) Date: Apr. 1, 2011

(87) PCT Pub. No.: WO2010/058250

PCT Pub. Date: May 27, 2010

(65) Prior Publication Data

US 2011/0187445 A1 Aug. 4, 2011

(51) Int. Cl.
*G05F 1/10* (2006.01)

(52) U.S. Cl. ..... 327/539

(58) Field of Classification Search ..... None
See application file for complete search history.

(56) References Cited

U.S. PATENT DOCUMENTS

| | | | | |
|---|---|---|---|---|
| 4,349,778 | A | 9/1982 | Davis | |
| 5,081,410 | A | 1/1992 | Wood | |
| 6,172,555 | B1 | 1/2001 | Gusinov | |
| 6,788,041 | B2 | 9/2004 | Gheorghe et al. | |
| 7,880,533 | B2 * | 2/2011 | Marinca | 327/539 |
| 7,919,999 | B2 * | 4/2011 | Narayanan et al. | 327/143 |
| 2005/0035813 | A1 | 2/2005 | Xi | |
| 2005/0122091 | A1 | 6/2005 | Marinca | |

FOREIGN PATENT DOCUMENTS

| | | | |
|---|---|---|---|
| EP | 0510530 | A | 10/1992 |
| WO | 2009/013572 | A1 | 1/2009 |
| WO | 2009/037532 | A | 3/2009 |

OTHER PUBLICATIONS

Rahajandraibe W et al: "Very Low Power High Temperature Stability Bandgap Reference Voltage," IEEE Solid-State Circuits Conference, 2002, ESSCIRIC, Proceedings of the 38th European, Florence, Italy, pp. 727-730.

Malcovati P et al: "Curvature-Compensated BiCMOS Bandgap With 1-V Supply Voltage," IEEE Journal of Solid-State Circuits, vol. 36, No. 7, Jul. 2001, pp. 1076-1081.

(Continued)

*Primary Examiner* — Lincoln Donovan
*Assistant Examiner* — Sibin Chen

(57) ABSTRACT

A complementary band-gap voltage reference circuit comprising first and second groups of transistors, each group containing a first transistor of npn type and a second transistor of pnp type and the transistors of different types in the same group having different emitter current conduction areas. The emitter-collector paths of the first transistors of each group are connected in parallel so as to present differential base-emitter voltages. The second transistors of each group are connected with their emitter-collector paths in parallel with a base-emitter junction of the first transistor of the same group so as to present differential base-emitter voltages of the second transistors across the first and second groups of transistors. The output regulated voltage is an additive function of the differential base-emitter voltages and of additive base-emitter voltages of transistors with smaller emitter current conduction area and different type.

20 Claims, 5 Drawing Sheets

OTHER PUBLICATIONS

Gunawan M et al: "A Curvature-Corrected Low-Voltage Bandgap Reference," IEEE Journal of Solid-State Circuits, vol. 28, No. 6, Jun. 1993, pp. 667-670.

Linear Technology: "2.5V Micropower SOT-23 Low Dropout Reference," Initial Release Final Electrical Specifications, LT1790-2.5, Mar. 2000, pp. 1-9.

Horn W et al: "A Robust Smart Power Bandgap Reference Circuit for Use in an Automotive Environment," IEEE Journal of Solid-State Circuits, vol. 37, No. 7 Jul. 2002, pp. 949-952.

International Search Report and Written Opinion correlating to PCT/IB2008/055646 dated Jul. 31, 2009.

* cited by examiner

COMPLEMENTARY BAND-GAP VOLTAGE REFERENCE CIRCUIT

FIELD OF THE INVENTION

This invention relates to a complementary band-gap voltage reference circuit.

BACKGROUND OF THE INVENTION

A widely used voltage reference supply is a band-gap circuit, which has typically been used to provide a low reference voltage with stability in the presence of temperature variations and noise or transients. In one form of band-gap circuit, known as a Brokaw circuit and described in the article "A simple Three-Terminal IC Bandgap Reference" in IEEE Journal of Solid-State Circuits, vol. SC9, no 6, December 1974, two groups of junction-isolated bipolar transistors run at different emitter current densities. The difference in emitter current densities produces a related difference between the base-emitter voltages of the two groups. This voltage difference is added to the base-emitter voltage of the transistor with higher emitter current density with a suitable ratio defined by a voltage divider. The temperature coefficient of the base-emitter voltage is negative and tends to compensate the positive temperature coefficient of the voltage difference.

A Brokaw band-gap circuit exhibits good stability and accuracy compared with other known circuits but still suffers from residual process dispersion, variability and temperature drift caused, for example, by mismatch of the mirror currents and base currents, especially when PNP transistors are used, which have low beta (collector-to-base current gain). PNP vertical transistors are preferred however for low power applications, to reduce parasitic effects in NPN vertical transistor integrated circuits, where parasitic horizontal transistor structures are formed by the different buried PN junctions, and high frequency current injection occurs due to DPI (direct power injection), with high frequency currents induced in the transistor collectors by parasitic capacitances at the buried PN junctions.

Especially, a standard Brokaw band-gap circuit also suffers from some inaccuracies due to dispersion of parameters due to manufacturing tolerances. While some of these sources of errors can be corrected during manufacturing, for example by trimming the products, such corrective actions do not give optimal results and increase manufacturing cost. Various circuits have been proposed with a view to reducing the sources of reference voltage inaccuracy in reference voltage circuits and also to ensuring low quiescent current.

The article "A curvature-corrected low-voltage bandgap reference" by Gunawan, M.; Meijer, G. C. M.; Fonderie, J.; Huijsing, J. H.; in the IEEE Journal of Solid-State Circuits Volume 28, Issue 6, June 1993 Page(s):667-670 and US patent specifications 20050122091, U.S. Pat. No. 5,081,410, 20050035813 and U.S. Pat. No. 6,172,555 describes various derivatives of the Brokaw circuit.

Our copending patent application PCT/IB2007/054337 describes a complementary bandgap circuit including two branches including respective groups of transistors of different emitter current conduction areas, each group including both pnp and npn transistors connected with their emitter-collector paths in series in the respective one of the branches. This arrangement provides an output voltage which is regulated to be substantially independent of variations in battery voltage and also to be independent of variations in operating temperature to a first order. The production dispersion of characteristics due to base current dispersion in the standard Brokaw circuit, notably due to production dispersion of the current gain of the transistors, can be reduced in this arrangement since the band-gap voltage Vbg is a function of the cumulated base-emitter voltage across two transistors of opposite type, a pnp and an npn with their base-emitter junctions connected in series and their emitter-collector paths in series. The cumulated voltage $Vbe_{p+n}$ across each pair of transistors is the average of the base-emitter voltages of the two transistors of the pair, which statistically reduces the dispersion of the cumulated voltages. This applies to the dispersion of the value of Vbg and also to the dispersion of its rate of variation with temperature.

The article "A robust Smart Power Bandgap reference circuit for use in an automotive environment" in the IEEE Journal describes a bandgap circuit using both npn and pnp transistors but the circuit is not a complementary bandgap circuit, the pnp transistors being part of a differential amplifier.

SUMMARY OF THE INVENTION

The present invention provides electrical supply apparatus as described in the accompanying claims.

These and other aspects of the invention will be apparent from and elucidated with reference to the embodiments described hereinafter.

BRIEF DESCRIPTION OF THE DRAWINGS

Further details, aspects and embodiments of the invention will be described, by way of example only, with reference to the drawings. Elements in the figures are illustrated for simplicity and clarity and have not necessarily been drawn to scale.

DETAILED DESCRIPTION OF THE PREFERRED EMBODIMENTS

Figure 1:
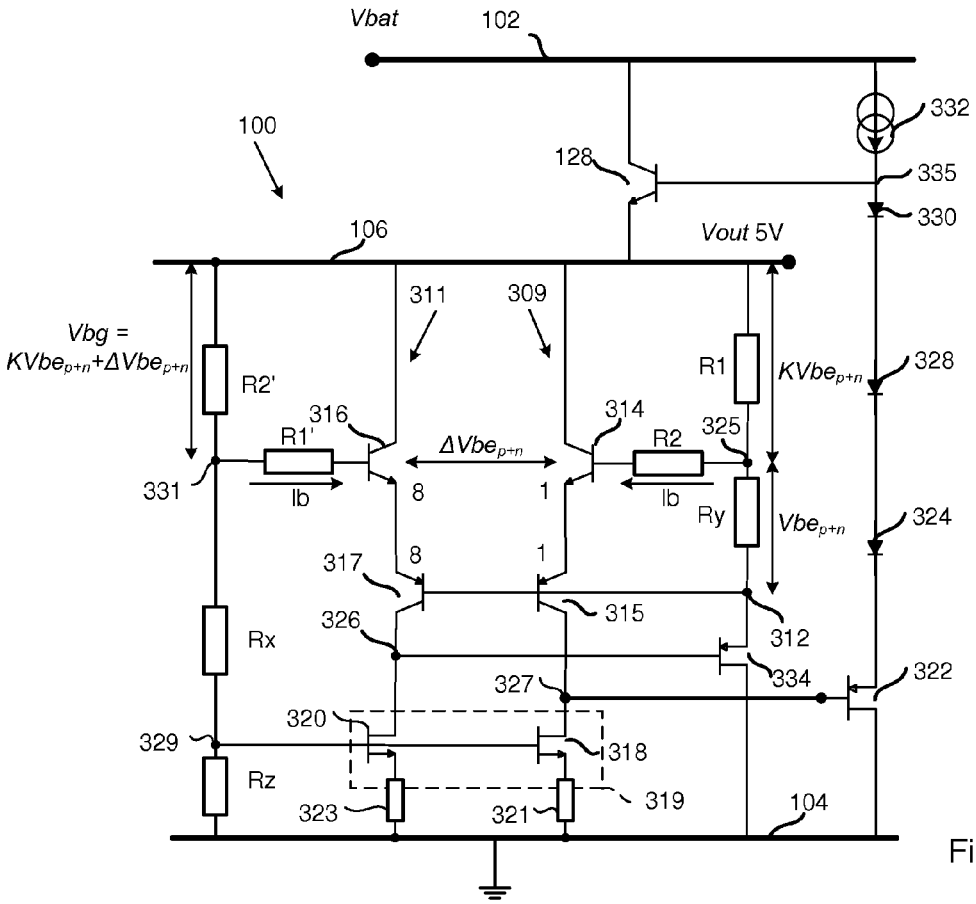
FIG. 1 is a schematic diagram of one configuration of the band gap reference voltage circuit of our copending patent application PCT/IB2007/054337.

FIG. 1 shows an example of an output circuit 100 in a voltage regulator described in our copending patent application PCT/IB2007/054337. The output circuit shown in FIG. 1 comprises a rail 102 supplied from a source of power, in this case a battery, not shown, with a voltage Vbat relative to ground 104. The voltage Vbat will typically be 12 volts but may be up to 40 volts in some automotive applications, for example. The voltage regulator 100 supplies an output voltage Vout, which is 5 volts in this example, on an output rail 106 to a load (not shown).

The output section 100 has first and second branches 309 and 311 extending from the output rail 106 to a current source 319 connected to ground 104. The first branch 309 comprises a group of transistors, consisting in this example of a pair comprising an npn-type bipolar transistor 314 and a pnp bipolar transistor 315 connected with their emitter-collector paths in series. The collector of the npn transistor 314 is connected to the output rail 106 and its emitter is connected to the emitter of the pnp transistor 315. The second branch 311 comprises a similar group consisting of an npn-type bipolar transistor 316 and a pnp bipolar transistor 317 connected with their emitter-collector paths in series. The transistors 314 and 315 of the first branch 309 have emitter current densities substantially higher than the emitter current densities of the second branch 311, in this case by a factor of 8 to 1.

The current source 319 includes n-type FETs 318 and 320 whose source-drain paths are connected in series with the branches 309 and 311 respectively, the drains of the FETs 318 and 320 being connected to the collectors of the transistors 315 and 317 respectively. The sources of FETs 318 and 320 are connected to ground 104 through respective resistors 321 and 322, so that the source-drain paths of the FETs present current conduction paths controlling the current flow in the branches 309 and 311 respectively. The gates of the FETs 318 and 320 are control electrodes for the current conduction paths and are coupled by common connection to a node 329, so that equal currents flow in the branches 309 and 311. Consequently, the series-connected pairs of transistors 314, 315 of the first branch and 316, 317 of the second branch run at different emitter current densities due to the different emitter areas, by a factor of 8 in the example given. Specifically, the node 329 is connected through a resistor Rz to ground 104 and is also connected through a resistor Rx to a node 331, which is connected through a resistor R2' to the output rail 106. A bias voltage appears at the node 329, which is connected to the gates of both the FETs 318 and 320.

A node 327 in the branch 309 of higher current density, connected to the drain of the FET 318 and the collector of the transistor 315, is connected to the gate of a p-type FET 322, whose drain is connected to ground 104 and whose source is connected through the series connection of three diodes 322, 328 and 330 and a node 335 to a current source 332, which is connected in turn to the output rail 106. The node 335 is connected to the base of an npn transistor 128 whose collector is connected to the battery rail 102 and whose emitter is connected to the output rail 106. The transistor 128 controls the flow of current from the supply rail 102 in response to the voltage at the node 327 between the current source 319 and the pair of transistors in the branch 309 of higher emitter current density, whereby to regulate the voltage at the output terminal 106.

In normal operation, the transistor 128 provides current through the resistors R2', Rx and Rz to bias control electrodes, which are the gates of the FETs 318 and 320, the FETs conducting sufficiently to pull their drain voltages down and for their source voltage to rise close to the bias voltage. Their source-drain currents are therefore defined by the bias voltage at the node 329 and the resistors 321 and 323, which are chosen to be equal, so as to produce equal currents in the two branches 309 and 311.

The voltage at the node 326 is applied to the gate of the FET 334, which conducts to pull down the voltage of the node 312 connected to its source. This voltage is applied to the bases of the transistors 314 to 317 causing the collector currents of the transistors 315 and 317 to rise sufficiently for their base-emitter voltages $Vbe_p$ to exceed their threshold voltage. Their collector currents stabilise at the value defined by the resistors 321 and 323. The voltage at the node 326 stabilises at a value where the voltage $Vbe_{p+n}$ between the nodes 312 and 325, applied to the resistor Ry, is equal to the sum of the base-emitter voltages $Vbe_n$ and $Vbe_p$ of the transistors 314 and 315, apart from a correction introduced by the resistor R2 for the effect of the base current of the transistor 314.

The coupled current sources formed by FETs 318 and 320 adjust the voltage at the node 327, applied to the FET 322. The FET 322 draws current from the current source 332 through the forward biased diodes 324, 328 and 330, introducing voltage drops to compensate for the base-emitter voltages of the transistors 315/317, 314/316 and the transistor 128. The voltage at the node 335 adjusts to a value that drives the transistor 128 to stabilise the voltages at the nodes 325 and 331, and hence the base voltages of the transistors 314 and 316, to values such that the currents are equal in transistors 314 and 316 and equal to the value defined by the resistors 321 and 323.

The transistors 314 and 315 of the first branch 309 have a smaller emitter area than the transistors 316 and 317 of the second branch 311, by a factor of 8 in this example. Since the emitter currents in the two branches are the same, the emitter current density is higher in the two transistors of the first branch 309 and the cumulated base-emitter voltage across the higher current density base-emitter junctions of the two transistors of the first branch 309 is higher than the cumulated base-emitter voltage across the lower current density base-emitter junctions of the two transistors of the second branch 311, the difference being denoted by $\Delta Vbe_{p+n}$.

The current flowing in the resistors R1 and Ry from the output rail 106 to the node 325 is the same, apart from a small correction due to the base-emitter current of the transistor 314 flowing in the resistor R1. The voltage divider formed by resistors Ry and R1 ensures that the voltage V1 across the resistor R1 is equal to the cumulated voltage $Vbe_{p+n}$ appearing across the series connection of the base-emitter junctions of the npn and pnp transistors 314 and 315 multiplied by a chosen factor K=R1/Ry to produce V1=$Vbe_{p+n}$*R1/Ry. The base-emitter voltages $Vbe_n$ and $Vbe_p$ of each of the npn and pnp transistors 314 and 315 are substantially identical and in the example shown, the cumulated base-emitter voltage $Vbe_{p+n}$ across the series combination of both the npn and pnp transistors 314 and 315 adjusts to a value equal to a band-gap voltage for Silicon transistors of 1250 mV and the factor K=R1/Ry is chosen to be 1/10, dividing the cumulated voltage across the two transistors of 1250 mV so that V1 equals 125 mV.

The difference in emitter current densities between the transistor pairs produces the difference in base-emitter voltages between the pair 314, 315 of the first branch 309 and the pair 316, 317 of the second branch 311, so that the cumulated difference $\Delta Vbe_{p+n}$ in base-emitter voltages between the branch 309 and the branch 311 is approximately 125 mV in this example.

The voltage difference Vbg appearing across the resistor R2' at node 331 is the sum of the voltage $\Delta Vbe_{p+n}$, approximately 125 mV at room temperature and which varies positively with temperature, and the voltage $KVbe_{p+n}$ across the resistor R1, derived from the cumulated base-emitter voltage $Vbe_{p+n}$ between the nodes 312 and 325, across the resistor Ry, also approximately 125 mV at room temperature in the example shown and which varies negatively with temperature. The negative coefficient of temperature variation of the voltage $Vbe_{p+n}$ (in this example approximately −0.4 mV/° K)

cancels the positive coefficient of temperature variation of the voltage difference $\Delta Vbe_{p+n}$ (in this example approximately +0.4 mV/° K), to a first order of approximation. The voltage Vbg, and hence the voltage Vout is thus regulated to be substantially independent of variations in power supply voltage Vbat.

The voltage divider formed by the resistors R2', Rx and Rz is chosen to give a suitable value for Vout and the voltage Vout at the output rail 106 stabilises at $$Vout = \frac{(R2' + Rx + Rz)}{R2'} Vbg.$$

In the present example these values are chosen so that Vout=5 volts, although other values can be obtained.

The production dispersion of characteristics due to base current dispersion in the standard Brokaw circuit, notably due to production dispersion of the current gain of the transistors, is reduced in this arrangement since the band-gap voltage Vbg is a function of the cumulated base-emitter voltage across two transistors of opposite type, a pnp and an npn with their base-emitter junctions connected in series and their emitter-collector paths in series. The cumulated voltage $Vbe_{p+n}$ across each pair of transistors is the average of the base-emitter voltages of the two transistors of the pair, which statistically reduces the dispersion of the cumulated voltages. This applies to the dispersion of the value of Vbg and also to the dispersion of its rate of variation with temperature.

The parameters of the voltage regulator of FIG. 1 are chosen so that it ought to be self-starting. However, there remains a risk that the circuit will not start by itself, due to various circumstances including unfavourable manufacturing variances and/or slow build up of the power voltage, for example, in which case voltage from the battery rail 102 may be supplied through a suitable start-up circuit (not shown), such as that described in our co-pending patent application PCT/IB2007/055361.

Our copending patent application PCT/IB2007/054337 describes also a variant of the output circuit 100 of FIG. 1, in which the series connection of pnp and npn bipolar transistors with current sources in each branch are inverted compared to FIG. 1. The current source is connected between the collectors of the npn transistors and the output line 106 and the collectors of the pnp transistors are connected to ground.

Figure 2:
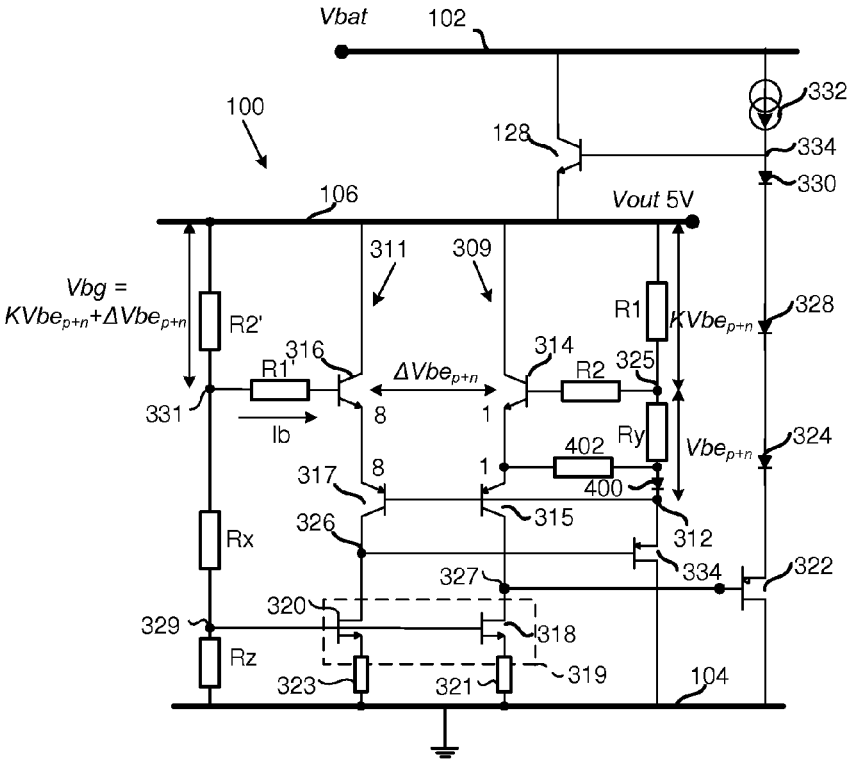
FIG. 2 is a schematic diagram of another configuration of the band gap reference voltage circuit of our copending patent application PCT/IB2007/054337.

The circuit of FIG. 1 provides a regulated output voltage that is temperature compensated to a first order, but is not compensated to a second order ('curvature compensation'). FIG. 2 shows a variation on the circuit of FIG. 1, described in our copending patent application PCT/IB2007/054337, that reduces the residual second order variation of the coefficient of temperature variation of the voltage difference $\Delta Vbe_{p+n}$ by adding a forward biased diode 400 or other PN junction in series with the resistor Ry between the nodes 312 and 325 and a resistor 402 connected between the connection between the diode 400 and the resistor Ry on one side and the connection between the emitters of the transistors 314 and 315 on the other side. With the addition of the diode 400, a substantial degree of compensation of the second order variation is obtained but the voltage $Vbe_{p+n}$ is no longer the average of the base-emitter voltages and the statistical production dispersion of the output regulated voltage is deteriorated.

In the circuits of FIGS. 1 and 2, the npn and pnp transistors of each branch have their emitter-collector paths in series. In practice, this means that the output regulated voltage cannot be less than a minimum value, of the order of 2 volts to 2.5 volts in this example. Certain applications may need a regulated voltage less than that minimum.

Figure 3:
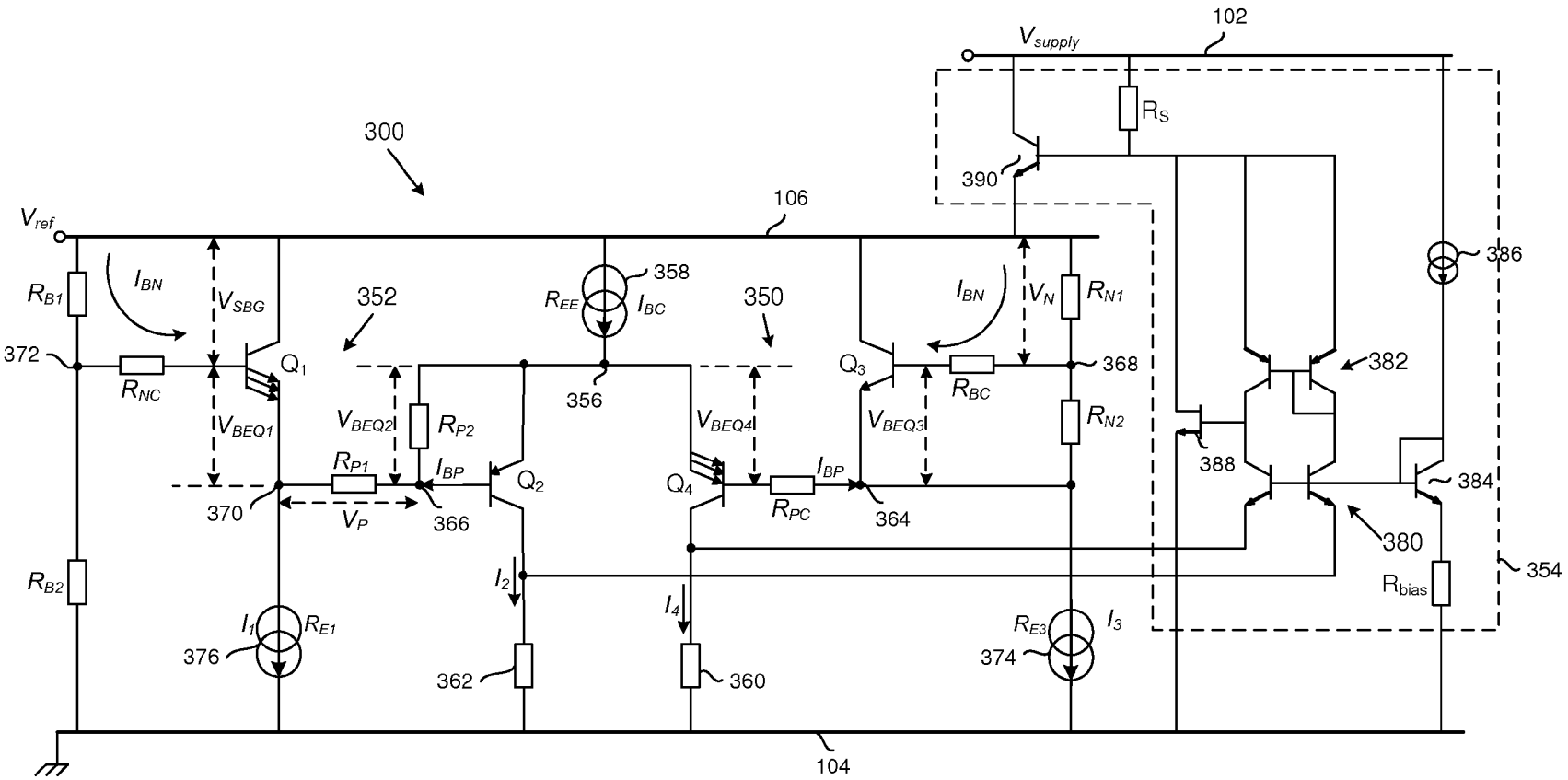
FIG. 3 is a schematic diagram of a band gap reference voltage circuit in accordance with one example of an embodiment of the present invention.

FIG. 3 shows an example of an output circuit 300 in a complementary band-gap voltage reference circuit in accordance with an example of an embodiment of the present invention. The circuit of FIG. 3 comprises first and second groups of transistors 350, 352, each group containing at least one transistor of npn type $Q_3$, $Q_1$ and at least one transistor of pnp type $Q_4$, $Q_2$, although there may be more than one transistor of each type in a group. The transistors of different types in the same group have different smaller or bigger emitter current conduction areas. The emitter-collector paths of a first transistor $Q_4$, $Q_2$ of each of the first and second groups is connected in parallel from a common connection so as to present differential base-emitter voltages $\Delta Vbe_P$ across the first transistors, the first transistors $Q_4$, $Q_2$ having a same first type and different emitter current conduction areas. A second transistor $Q_3$, $Q_1$ of each of the first and second groups is connected with its emitter-collector path in parallel with a base-emitter junction of the first transistor $Q_4$, $Q_2$ of the same group so as to present differential base-emitter voltages of the second transistors $\Delta Vbe_N$ across the first and second groups 350, 352, the second transistors having the same type and a different emitter current conduction areas. Output terminals 104, 106 are connected to receive a regulated voltage Vref which is an additive function of the differential base-emitter voltages $\Delta Vbe_P$, $\Delta Vbe_N$ and of additive base-emitter voltages $Vbe_{Q3}$, $Vbe_{Q2}$ of those transistors $Q_3$, $Q_2$ with smaller emitter current conduction area and different type. The transistors of additive base-emitter voltages $Vbe_{Q3}$, $Vbe_{Q2}$ are transistors $Q_2$, $Q_3$ of the first and second groups 350, 352. The regulated voltage Vref is arranged to be an additive function of a voltage $V_N$ which is proportional to the base-emitter voltage $Vbe_{Q3}$ of a transistor $Q_3$ of the first group 350 with higher emitter current density base-emitter, a voltage $V_P$ which is proportional to the base-emitter voltage $Vbe_{Q2}$ of a transistor $Q_2$ of the second group 352 with higher emitter current density, and of the differential base-emitter voltages $\Delta Vbe_N$, $\Delta Vbe_P$.

The output terminals 104, 106 are connected to receive current from a supply rail 102 through a driver 354 responsive to a differential voltage across the first transistors $Q_4$ and $Q_2$, whereby to regulate the voltage at the output terminals.

In more detail, the first group of transistors 350 comprises an npn bipolar transistor $Q_3$ and a pnp bipolar transistor $Q_4$ and the circuit is arranged so that the current $I_3$ flowing in the emitter-collector path of the transistor $Q_3$ is substantially equal to the current $I_4$ flowing in the transistor $Q_4$.

Similarly, the second group of transistors 352 comprises an npn bipolar transistor $Q_1$ and a pnp bipolar transistor $Q_2$ and the circuit is arranged so that the current $I_2$ flowing in the emitter-collector path of the transistor $Q_2$ is substantially equal to the current flowing in the transistor $Q_1$.

The transistor $Q_3$ has a smaller emitter current conduction area then the transistor $Q_1$ and the currents flowing in them are arranged to be approximately the same, so that the emitter current density of the transistor $Q_3$ is substantially higher than that of the transistor $Q_1$. In this example the emitter current conduction area of the transistor $Q_1$ is 8 times that of the transistor $Q_3$. Similarly, the transistor $Q_2$ has a smaller emitter current conduction area than the transistor $Q_4$, so that the emitter current density of the transistor $Q_2$ is substantially higher than that of the transistor $Q_4$. In this example the emitter current conduction area of the transistor $Q_4$ is 8 times that of the transistor $Q_1$.

The emitters of the first transistors $Q_4$ and $Q_2$ of each of the first and second groups is connected to a common emitter node 356, which is connected by a constant current source 358 to the output rail 106. The constant current source 358 may be a resistance $R_{EE}$. The collectors of the first transistors $Q_4$ and $Q_2$ are connected through respective resistors 360 and 362 to the supply rail 104, at ground in this example although it may be at a different potential, so that the emitter-collector paths of the first transistors $Q_4$ and $Q_2$ of each of the first and second groups are connected in parallel and present differential base-emitter voltages $\Delta Vbe_P$ across the first transistors between nodes 364 and 366 connected respectively to their base electrodes, through a base current compensation resistor $R_{PC}$ in the case of the transistor $Q_4$.

The collector of the second transistor $Q_3$ of the first group 350 is connected to the output line 106 and its emitter is connected to the node 364, so that the emitter-collector path of the transistor $Q_3$ is in parallel with the base-emitter junction of the first transistor $Q_4$ of the same group and the constant current source 358, and its base electrode is connected through a base current compensation resistor $R_{BC}$ to a node 368.

The collector of the second transistor $Q_1$ of the second group 352 is connected to the output line 106 and its emitter is connected to a node 370. The node 370 is connected to the node 366 of the base of the transistor $Q_2$ through a resistor $R_{P1}$, so that the emitter-collector path of the transistor $Q_1$ is in parallel with the base-emitter junction of the first transistor $Q_2$ of the same group and the constant current source 358, and its base electrode is connected through a base current compensation resistor $R_{NC}$ to a node 372. Accordingly, base-emitter voltages of the second transistors $Q_3$, $Q_1$ cumulate in opposition and present differential base-emitter voltages of the second transistors $\Delta Vbe_P$ across the first and second groups 350, 352, between the nodes 368 and 370. It will be recalled that the second transistors $Q_1$ and $Q_3$ have the same type, npn, and a different emitter current conduction area.

A voltage divider comprises a resistor $R_{N1}$ connected between the output line 106 and the node 368 and a resistor $R_{N2}$ connected between the node 368 and the node 364. The node 364 is connected to the ground supply rail 104 through a constant current source 374, which may be a resistance $R_{E3}$.

A resistor $R_{P2}$ is connected between the node 366 and the common emitter node 356 and forms a voltage divider with the resistor $R_{P1}$. The node 370 is connected to the ground supply rail 104 through a constant current source 376, which may be a resistance $R_{E1}$.

A voltage divider comprises a resistor $R_{B1}$ connected between the output line 106 and the node 372 and a resistor $R_{B2}$ connected between the node 372 and the ground supply rail 104.

In normal operation, when the driver 354 starts to apply voltage on the output line 106, the emitters of the transistors $Q_4$ and $Q_2$ and the collectors of the transistors $Q_3$ and $Q_1$ start to rise in potential faster than their bases, which are held down by the current sources 374 and 376 until the base-emitter voltages exceed their threshold voltages. The collector currents of the transistors $Q_4$ and $Q_2$ stabilise at values defined by the rise in potential across the resistors 360 and 362, which reduces the emitter-collector voltages of the transistors $Q_4$ and $Q_2$. The collector currents of the transistors $Q_3$ and $Q_1$ stabilise at values defined by the rise in potential across the current sources 374 and 376, which reduces the emitter-collector voltages of the transistors $Q_3$ and $Q_1$.

The same current flows in the resistors $R_{N1}$ and $R_{N2}$, apart from a correction for the base current of the transistor $Q_3$, and the transistor $Q_3$ holds the voltage across the resistor $R_{N2}$ at the band-gap voltage of the transistor, $V_{BEQ3}$, so that the voltage $V_N$ across the resistor $R_{N1}$ is equal to:

$$V_N = V_{beQ3}\frac{R_{N1}}{R_{N2}}$$

The same current flows in the resistors $R_{P1}$ and $R_{P2}$, apart from a correction for the base current of the transistor $Q_2$, and the transistor $Q_2$ holds the voltage across the resistor $R_{P2}$ at the band-gap voltage of the transistor, $V_{BEQ2}$, so that the voltage $V_P$ across the resistor $R_{PS}$ is equal to:

$$V_P = V_{beQ2}\frac{R_{P1}}{R_{P2}}$$

The voltage between the node 372 and the output line 106 is the same as the voltage $V_{SBG}$ between the base of the transistor $Q_1$ and its collector, connected to the output line 106 apart from base current flowing in the resistor $R_{NC}$. The voltage $V_{SBG}$ is an additive function of the differential base-emitter voltages $\Delta Vbe_N$, $\Delta Vbe_P$ and of variables $V_P$ and $V_N$ proportional to the base-emitter voltages $Vbe_{Q3}$, $Vbe_{Q2}$ of those transistors $Q_2$, $Q_3$ of the first and second groups with higher emitter current density. The base-emitter voltages $Vbe_{Q3}$, $Vbe_{Q2}$ are complementary bandgap voltages which are constant to a first approximation and the addition with the complementary bandgap differential base-emitter voltages $\Delta Vbe_N$, $\Delta Vbe_P$ gives temperature compensation not just to a first order but also curvature compensation, as will be described more fully below.

In more detail, the parallel connections of the resistors $R_{N1}$ and $R_{B1}$ with the transistors $Q_1$, $Q_2$, $Q_3$ and $Q_4$, ensures that, apart from compensation for base currents, the voltage $V_{SBG}$ is equal to:

$$V_{SBG}=V_N+V_{beQ3}-V_{beQ4}+V_{beQ2}+V_P-V_{beQ1}$$

The differences $(V_{BEQ3}-V_{BEQ1})=\Delta Vbe_N$ and $(V_{BEQ2}-V_{BEQ4})=\Delta Vbe_P$ are the complementary bandgap differences, so that:

$$V_{SBG}=V_N+V_P+\Delta Vbe_N+\Delta Vbe_P$$

The production dispersion of $V_{SBG}$ is a function of the uncorrelated pairs of terms $\Delta Vbe_N$, $\Delta Vbe_P$ and $V_P$, $V_N$. Dispersion of the manufacturing parameters of the transistors of the same type is to a large extent eliminated, since all the transistors are made in the same substrate and the transistors of the same type are made in the same process steps and therefore are matched. The production dispersions of the pairs of terms are relatively uncorrelated because the manufacturing processes for the components defining the bias currents for the relevant transistors of the two terms of the pair are different. Accordingly, the production dispersion ('Offset') of $V_{SBG}$ is the sum of the root-mean-squares of the production dispersions of the pairs of terms:

$$V_{SBG(Offset)} = \Delta Vbe_{(Offset)} + Vbe_{(Offset)}$$

$$\Delta Vbe_{(Offset)} = \frac{\sqrt{\Delta Vbe^2_{N(Offset)} + \Delta Vbe^2_{P(Offset)}}}{\Delta Vbe_N + \Delta Vbe_P}, \text{ and}$$

$$Vbe_{(Offset)} = \frac{\sqrt{Vbe^2_{N(Offset)} + Vbe^2_{P(Offset)}}}{Vbe_N + Vbe_P}$$

If the magnitudes of the production dispersions of the terms for the npn-type transistors is equal to the terms for the pnp-type transistors, the dispersion of $V_{SBG}$ is divided by $\sqrt{2}$ compared to a circuit in which the production dispersions of the transistor base-emitter voltages are correlated, which would be the case if the transistors were all of the same type (npn or pnp) and their bias currents were correlated:

$$V_{SBG(Offset)} = \frac{\sqrt{\Delta Vbe_{(Offset)} + \Delta Vbe}_{(Offset)}}{\Delta Vbe + \Delta Vbe} + \frac{\sqrt{Vbe_{(Offset)} + Vbe_{(Offset)}}}{Vbe + Vbe} = \frac{\sqrt{2}\cdot\Delta Vbe_{(Offset)}}{2\cdot\Delta Vbe} + \frac{\sqrt{2}\cdot Vbe_{(Offset)}}{2\cdot Vbe} = \frac{1}{\sqrt{2}}\left[\frac{\Delta Vbe_{(Offset)}}{\Delta Vbe}\right] + \frac{1}{\sqrt{2}}\left[\frac{Vbe_{(Offset)}}{Vbe}\right]$$

The same current flows in resistors $R_{B1}$ and $R_{B2}$, apart from a correction for the base current of the transistor $Q_1$. The driver 354 maintains the voltage $V_{ref}$ between the rails 104 and 106 at a value such that $$V_{ref} = V_{SBG}\cdot\frac{R_{B1} + R_{B2}}{R_{B1}}$$

and is therefore regulated since it is defined by the complementary bandgap voltages, as described above.

The regulated output reference voltage $V_{ref}$ may be as low as 1.250 volts, unlike the circuits of FIGS. 1 and 2, since the npn transistors are in parallel with the pnp transistors, not in series, and their bandgap voltages are not cumulated in the same way as in the circuits of FIGS. 1 and 2. This may be desirable for certain applications, although the circuit of FIG. 3 can be designed to produce a higher output reference voltage $V_{ref}$ if desired.

The circuit of FIG. 3 enables base current compensation without the addition of further components specific to the compensation function. The base current $I_{BPQ2}$ flowing in resistor $R_{P1}$ produces an error $V_{Perror}$ in the voltage $V_P$ across the resistor $R_{P1}$. Since the currents in the transistors $Q_4$ and $Q_2$ are the same, the voltage error across the resistor $R_{P1}$ can be compensated by a similar error of opposite effect on $V_{SBG}$ in the voltage across the resistor $R_{pc}$ by choosing $R_{PC}=R_{P1}$. This compensation works because $R_{P2}/R_{P1}>10$.

Similarly, the base current $I_{BN}$ flowing in resistor $R_{N1}$ produces an error $V_{Nerror}$ in the voltage $V_N$ across the resistor $R_{N1}$. Since the currents in the transistors $Q_3$ and $Q_1$ are the same, the voltage error across the resistor $R_{N1}$ can be compensated by a similar error of opposite effect on $V_{SBG}$ in the voltage across the resistor $R_{NC}$ by choosing $R_{NC}=R_{N1}$. This works because $R_{N2}/R_{N1}>10$.

Also, the base current $I_{BN}$ flowing in resistor $R_{B1}$ produces an error $V_{Berror}$ in the voltage $V_{B1}$ across the resistor $R_{B1}$. This can be compensated by a similar error of opposite effect on $V_{SBG}$ in the voltage across the resistor $R_{BC}$ by choosing $R_{BC}=R_{B1}$. This works because $R_{B2}/R_{B1}>5$ The bias current sources 358, 374 and 376 can also be chosen to reduce their effect on the production dispersion of $V_{SBG}$. For example, the current source 374 can be replaced by a resistance $R_{E3}$ formed in a lightly doped p-type high voltage 'PHV' region in the substrate of the circuit for the npn transistor $Q_3$. Similarly, the current source 376 can be replaced by a resistance $R_{E1}$ formed in a lightly doped p-type PHV region in the substrate of the circuit for the npn transistor $Q_1$. The current source 358 can be replaced by a resistance $R_{EE}$ formed in a p-type lightly-doped 'well' region in the substrate of the circuit for the pnp transistors $Q_4$ and $Q_2$. Since the production process parameters of the PHV region resistors are not correlated with the production process parameters of the Well region resistors, the overall production dispersion of $V_{SBG}$ is reduced. Also, the production dispersion of the bias currents of the npn transistors is not correlated with the production dispersion of the bias currents of the pnp transistors, due to their different production processes, which reduces their effect on the production dispersion of $V_{SBG}$.

Figure 4:
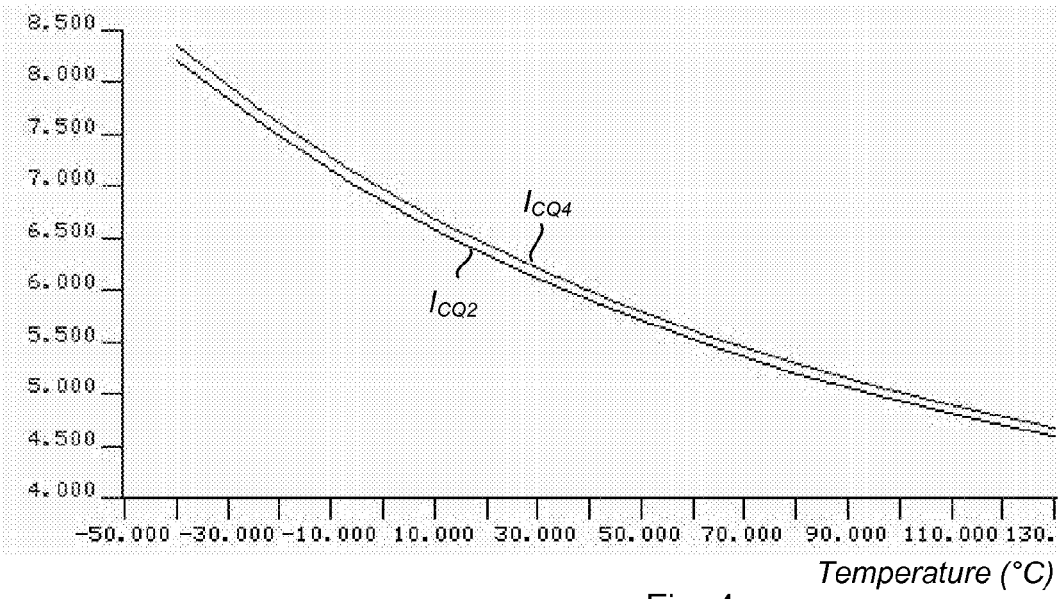
FIG. 4 is a graph of variation with temperature of some currents appearing in operation of an example of an implementation of the band gap reference voltage circuit of FIG. 3.

As described above, the circuit provides first order compensation for temperature variations. In addition, the circuit provides second order temperature compensation. The driver 354 adjusts the voltage $V_{ref}$ applied to the output rail 106 so as to maintain the voltages at the collectors of the transistors $Q_4$ and $Q_2$ at the same value whatever the temperature. These voltages appear across the collector resistors 360 and 362 respectively, which are chosen to have the same value so that the collector currents $I_{CQ4}$ and $I_{CQ2}$ are maintained at the same values whatever the temperature, as shown in FIG. 4, which shows the current in μA as a function of temperature in ° C.

Figure 5:
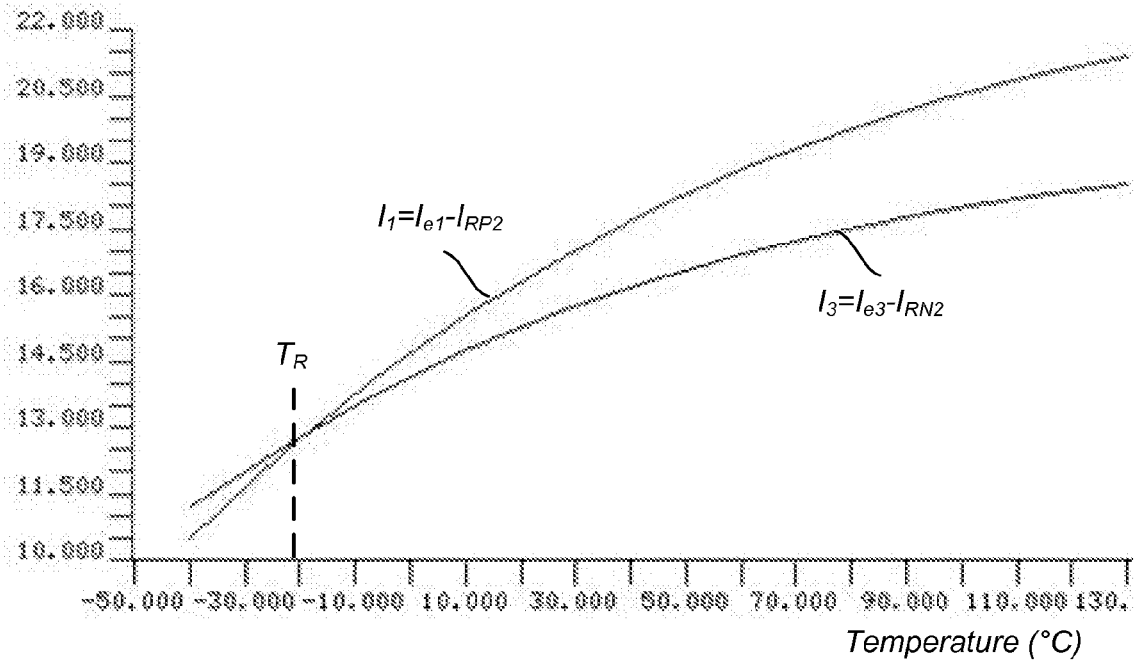
FIG. 5 is a graph of variation with temperature of other currents appearing in operation of an example of an implementation of the band gap reference voltage circuit of FIG. 3.

The currents $I_3$ and in the resistors $R_{E3}$ and $R_{E1}$ are the sums of the emitter currents $I_{E3}$ and $I_{E1}$ of the transistors $Q_3$ and $Q_1$ and of the currents $I_{RN2}$ and $I_{RP2}$ flowing in the resistors $R_{N2}$ and $R_{P2}$. They vary with temperature as shown in FIG. 5, and have the same value at a temperature $T_R$: The currents $I_3$ and $I_1$ vary differently with temperature from each other and from the currents $I_4$ and $I_2$ because the collector voltages $V_{eQ1}$ and $V_{eQ3}$ of the transistors $Q_1$ and $Q_3$ vary differently with temperature.

As noted above, the voltage across the resistor $R_{B1}$ equals $V_{SBG}$ apart from the base current flowing in the resistor $R_{NC}$, and is given by:

$$V_{SBG}=V_N+V_P+\Delta Vbe_N+\Delta Vbe_P$$

$V_N$ and $V_P$ are proportional to the corresponding base-emitter voltages Vbe.

The base-emitter voltages Vbe vary with temperature approximately according to the following equation:

$$Vbe(T) = V'_{G0} - (V'_{G0} - Vbe_R)\cdot\frac{T}{T_R} - V_T\cdot(n-x)\cdot\ln\left(\frac{T}{T_R}\right)$$

Where:

$V'_{g0}$ is the extrapolated band-gap voltage at 0° K $Vbe_R$ is the base-emitter voltage at the reference temperature $T_R$ n is a process dependent constant x is equal to 1 if the bias current is a 'PTAT' current (Proportional To Absolute Temperature) and equal to 0 if the current is temperature independent.

In practice, in one example of an embodiment of the invention, $V'_{g0}$=1170 mV and n=3.6.

The voltage $V'_{G0}$ is a constant. The second term varies negatively with temperature, substantially linearly, and the third term, also varies negatively with temperature, but nonlinearly. Accordingly, there remains a second order variation to be compensated.

The complementary bandgap differential base-emitter voltages ΔVbe vary with temperature approximately according to the following equation:

$$\Delta Vbe = \frac{kT}{q}\log_n \frac{J_x}{J_y}$$

where $J_x/J_y$, is the ratio of the emitter current densities of the corresponding transistors and is equal to 8 in this example of an embodiment of the invention. A high degree of second order compensation of the output reference voltage can be obtained as well as first order compensation. The second order compensation is set by choosing the values of the resistances $R_{P2}$ and $R_{N2}$ so as to adjust the emitter voltages and hence the emitter currents of the transistors $Q_3$ and $Q_1$.

The overall result is given approximately by the following equation:

$$V_{be}(T) = V'_{G0} - (V'_{G0} - V_{beR}) \cdot \frac{T}{T_R} - V_T \cdot (n - x) \cdot \ln\left(\frac{T}{T_R}\right) + V_T \cdot \alpha \cdot \ln\left(\frac{I_{Q3}}{I_{Q1}}\right)$$

The value of the output regulated voltage $V_{ref}$ and the variation with temperature can be adjusted by adjusting the value of the parameter $\alpha$, which is a function of $R_{N2}$, $R_{p2}$, $R_{E1}$ and $R_{E3}$, which adjusts the ratio between the collector currents $I_4$ and $I_2$ of the transistors $Q_4$ and $Q_2$.

For an output regulated voltage $V_{ref}$ of 1.250 volts, the variation of the output voltage of the circuit of FIG. 3 between −40° C. and +130° C. can be limited to 0.5 mV. This variation is lower than that obtainable by the circuit of FIG. 1.

The production dispersion of the circuit of FIG. 3 at 1 sigma can be limited to 1.3 mV, substantially better than the production dispersion of the circuit of FIG. 2. This reduction in production dispersion enables manufacturing test time to be reduced and also reduces the work of trimming products that are at or outside tolerance limits.

The reductions in production dispersion and temperature variation, with curvature compensation are obtained without additional components and especially without the need for special manufacturing processes, such as would be required by the use of thin film resistors, for example.

FIG. 3 shows an example of implementation of the driver 354 in one embodiment of the invention. In this example, the driver 354 comprises a differential pair of npn transistors 380 whose emitters are connected to respective collectors of the transistors $Q_4$ and $Q_2$. The collectors of the transistors 380 are connected to respective collectors of a current mirror pair of transistors 382. The bases of the transistors 380 are connected in common to the base and collector of an npn transistor 384, whose emitter is connected through a bias resistor $R_{bias}$ to ground, and whose collector, connected to the common bases, is connected through a current source 386 to the supply rail 102. The gate of an FET 388 is connected to the collectors of one side of the transistor pairs 380 and 382 and the source of the FET 388 is connected to ground. The drain of the FET 388 and the emitters of the current mirror transistor pair 382 are connected through a resistor $R_S$ to the supply rail 102 and to the base of an npn transistor 390. The collector of the transistor 390 is connected to the supply rail 102 and its emitter is connected to the reference voltage rail 106.

In operation, the current source 386, is used to bias the bases of the npn transistor pair 380 and at 1Vbe+Rbias*I386 (I386=source current of transistor 384). Since the bases of the transistor pair 380 have the same DC voltage, the emitters of the transistor pair 380 force the voltage across the resistors 362 and 360. The resistors 362 and 360 see the sum of the current from the current source 358 and currents from the pnp transistor pair 382. The emitters of the npn transistor pair 380 are the inputs of the amplifier. The closed loop feedback tends to keep the collectors of the transistors Q2 and Q4 at the same voltage.

The collector voltages $V_{cQ2}$, and $V_{cQ4}$ of the transistors $Q_2$ and $Q_4$ are only equal when the regulated voltage $V_{ref}$ has the exact value needed by the system. If the reference voltage $V_{ref}$ rises above its nominal value, the collector voltage $V_{cQ4}$ of the transistor $Q_4$ with greater emitter area and lower emitter current density rises more than the collector voltage $V_{cQ2}$ of the transistor $Q_2$ with lesser emitter area: in this example, if $V_{ref}$>1.25, $V_{cQ4}$>$V_{cQ2}$. The amplifier 354 then increases the gate voltage of the FET 388. As a consequence the base voltage of the transistor 390 decreases to bring the $V_{ref}$ value equal to 1.25. Similarly, if $V_{ref}$<1.25, VcQ4<VcQ2, so the amplifier decreases the gate of voltage of the FET 388. As a consequence the base voltage of the transistor 390 increases to bring the $V_{ref}$ value equal at 1.25. The FET 388 drives the base voltage of the transistor 390, which is equal to $V_{ref}$+Vbe of 390. So the FET 390 is controlling the $V_{ref}$ value through the amplifier.

Figure 6:
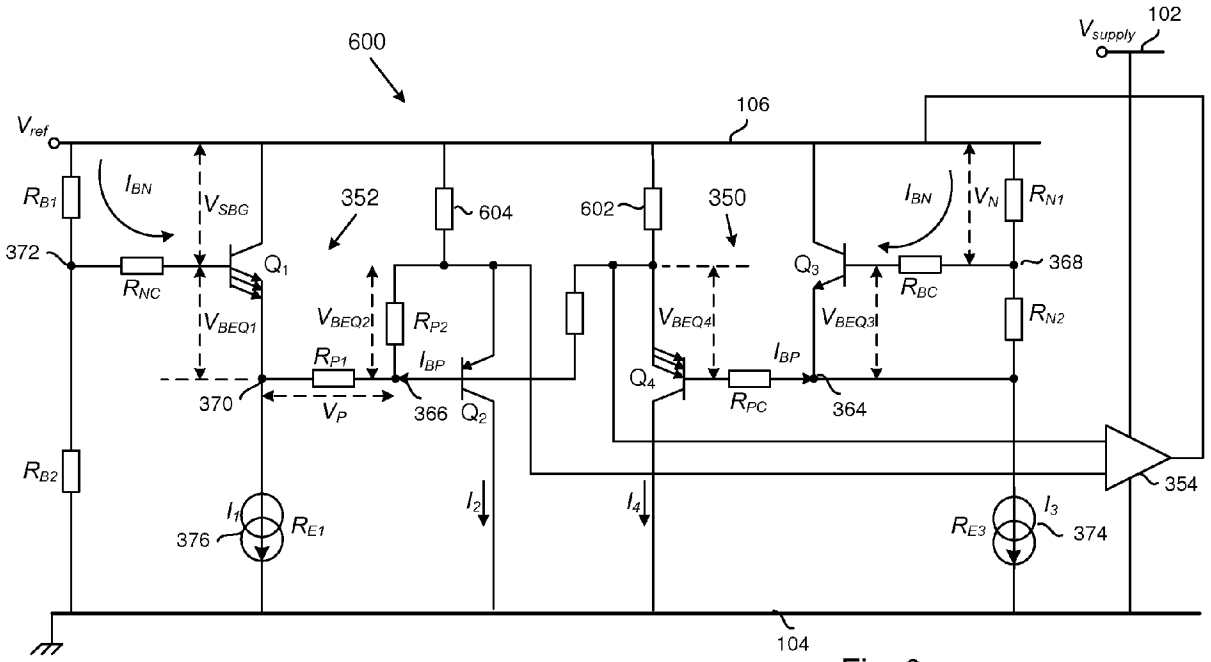
FIG. 6 is a schematic diagram of a band gap reference voltage circuit in accordance with another example of an embodiment of the present invention.
Figure 7:
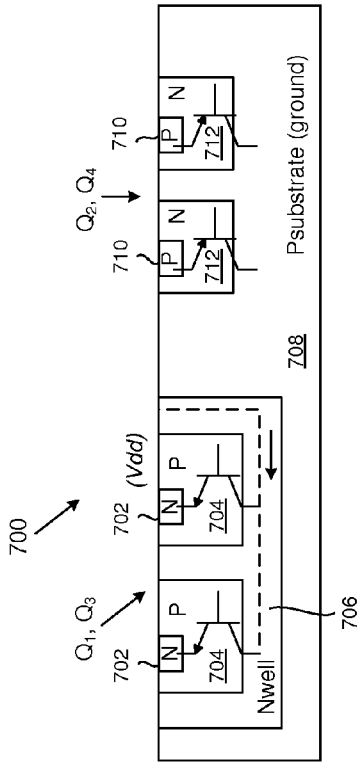
FIG. 7 is a schematic section of a semiconductor device including part of the band gap reference voltage circuit of FIG. 6.

Another example of an embodiment of the invention is shown in FIGS. 6 and 7. In this embodiment, the architecture of the circuit of FIG. 3 is modified so that all the transistors $Q_1$ to $Q_4$ are connected in common collector configuration. In the example of FIG. 6, the collectors of the transistors $Q_4$ and $Q_2$ are connected directly to ground 104. Instead of being connected to a common current source, as in FIG. 3, the emitters of the transistors $Q_4$ and $Q_2$ are connected through respective resistors 602 and 604 to the output rail 106 and, instead of being connected to the collectors of the transistors $Q_4$ and $Q_2$, the inputs of the driver 354 are connected to the emitters of the transistors $Q_4$ and $Q_2$. This architecture enables a simplified integrated circuit structure 700 in Complementary metal-oxide-semiconductor ('CMOS') technology, as illustrated in the section of FIG. 7. The integrated circuit 700 comprises both the npn transistors $Q_3$ and $Q_1$ and the pnp transistors $Q_4$ and $Q_2$ formed as vertical bipolar transistors in a single die. The emitters 702 of the npn transistors $Q_3$ and $Q_1$ are formed by diffusion or other suitable technique of n-type dopant from a top surface of the die into p-type base regions 704 previously formed from the top surface into an n-type well region 706 formed initially from the top surface in a substrate 708. The well region 706 forms the collector of the npn transistor, to which contact can be made from the top surface. The substrate 708 can be connected to ground from the bottom surface of the die. The emitters 710 of the pnp transistors $Q_4$ and $Q_2$ are formed by diffusion or other suitable technique of p-type dopant from a top surface of the die into n-type base regions 712 previously formed from the top surface into the substrate 708, which forms the collector of the pnp transistors, connected to ground from the bottom surface of the die.

Figure 8:
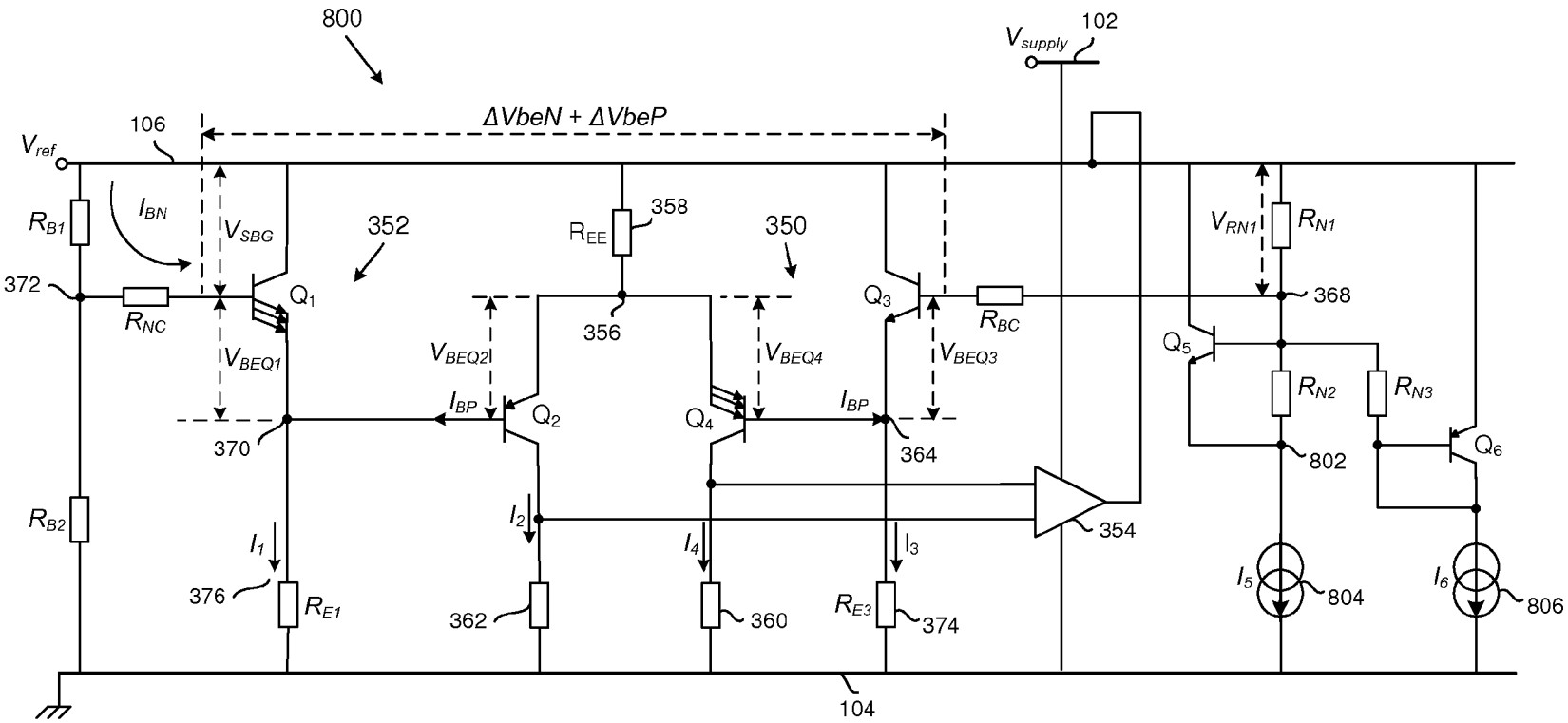

Yet another example of an embodiment of the invention is shown in FIG. 8, in which elements similar in function to those of FIG. 3 have the same references. In this embodiment of complementary band-gap voltage reference circuit 800, the architecture of the circuit of FIG. 3 is modified so that the transistors $Q_1$, $Q_2$, $Q_3$ and $Q_4$ are only used to obtain the additive differential base-emitter voltages $\Delta Vbe_N$, $\Delta Vbe_P$, and additive base-emitter voltages $Vbe_{Q3}$, $Vbe_{Q2}$ are obtained by additional transistors $Q_5$ and $Q_6$. with smaller emitter current conduction area and different type whose emitter-collector paths are connected in parallel with emitter-collector paths of said first and second groups.

As shown in FIG. 8, the node 368 is connected to the base of the transistor $Q_5$, which is of npn type in this example and the node 368 is connected through the resistor $R_{N1}$ to the regulated output rail 106. The collector of the transistor $Q_5$ is connected to the regulated output rail 106 and its emitter is connected to a node, 802 which is connected through the resistor $R_{N2}$ to the node 368 and through a current source 804 to the ground rail 104. The emitter of the transistor $Q_6$, which is of pnp type in this example, is connected to the regulated output rail 106 and its collector is connected to its base and, through a resistor $R_{N3}$, to the node 368. The collector and base of the transistor $Q_6$ are connected through a current source 806 to the ground rail 104.

The voltage between the base of the transistor $Q_3$ and the base of the transistor $Q_1$ is equal to the addition of the complementary bandgap voltage differences $\Delta Vbe_N$ and $\Delta Vbe_p$, to which is added the voltage across the resistor $R_{N1}$. Accordingly, the parallel connections of the resistors $R_{N1}$ and $R_{B1}$ with the transistors $Q_1$, $Q_2$, $Q_3$ and $Q_4$, ensures that, apart from compensation for base currents, the voltage $V_{SBG}$ is given by:

$$V_{SBG}=V_{RN1}+\Delta Vbe_N+\Delta Vbe_P$$

Apart from a correction for the base current of the transistor $Q_3$, the voltage $V_{RN1}$ across the resistor $R_{N1}$ is produced by the sum of the currents in the resistors $R_{N2}$ and $R_{N3}$ and is defined by the voltage dividers $R_{N1}$, $R_{N2}$ and $R_{N1}$, $R_{N3}$ and by the base-emitter voltages $V_{beQ5}$ and $V_{beQ5}$ of the transistors $Q_5$ and $Q_6$. $V_{RN1}$ is proportional to an additive function of the base-emitter voltages $V_{beQ5}$ and $V_{beQ5}$.

$$V_{RN1}\cdot\frac{(R_{N1}+R_{N3})}{R_{N3}}=V_{beQ5}\cdot\frac{R_{N1}}{R_{N2}}+V_{beQ6}\cdot\frac{R_{N1}}{R_{N3}}$$

In this example, the values of the resistors $R_{N1}$, $R_{N2}$ and $R_{N3}$ are chosen so that the voltage $V_{RN1}$ is proportional to the sum $V_{beQ5}+V_{beQ6}$ of the base-emitter voltages $V_{beQ5}$ and $V_{beQ6}$ of the transistors $Q_5$ and $Q_6$. Also, the resistors $R_{N1}$, $R_{N2}$ and $R_{N3}$ are of similar type and are manufactured by the same process, so that they do not introduce variation of $V_{RN1}$ with temperature nor process dispersion. The production dispersions of the base-emitter voltages $V_{beQ5}$ and $V_{beQ6}$ are arranged to be relatively uncorrelated with each other and with the dispersions of the complementary bandgap voltage differences $\Delta Vbe_N$ and $\Delta Vbe_P$ by arranging the manufacturing processes and circuits for the components defining the bias currents for the two transistors to be different, so that the dispersion of $V_{SBG}$ is further reduced compared to the example of FIG. 3. For example, one of the current sources 804 and 806 can be replaced by a resistor formed in the PHV region and the other by a resistor in the Well region. As in the example of FIG. 3, the production dispersion ('Offset') of $V_{SBG}$ is the sum of the root-mean-squares of the production dispersions of the pairs of terms:

$$V_{SBG(Offset)}=\Delta Vbe_{(Offset)}+Vbe_{(Offset)},\text{ and}$$

$$\Delta Vbe_{(Offset)}=\frac{\sqrt{\Delta Vbe^2_{N(Offset)}+\Delta Vbe^2_{P(Offset)}}}{\Delta Vbe_N+\Delta Vbe_P}$$

$$Vbe_{(Offset)}=\frac{\sqrt{V^2_{beQ5(Offset)}+V^2_{beQ6(Offset)}}}{V_{beQ5}+V_{beQ6}}$$

Dispersion of the manufacturing parameters of the transistors of the same type is to a large extent eliminated, since all the transistors are made in the same substrate and the transistors of the same type are made in the same process steps and therefore are matched.

The regulated output reference voltage $V_{ref}$ may again be as low as 1.250 volts, since the npn transistors are in parallel with the pnp transistors, not in series. The 1 sigma production dispersion of $V_{ref}$ in one implementation of this example was 1.1 mV, As in the example of FIG. 3, the base current $I_{BN}$ flowing in resistor $R_{N1}$ produces an error $V_{Nerror}$ in the voltage $V_N$ across the resistor $R_{N1}$. Since the currents in the transistors $Q_3$ and $Q_1$ are the same, the voltage error across the resistor $R_{N1}$ can be compensated by a similar error of opposite effect on $V_{SBG}$ in the voltage across the resistor $R_{NC}$ by choosing $R_{NC}=R_{N1}$. This works because $R_{N2}/R_{N1}>10$.

Also, the base current $I_{BN}$ flowing in resistor $R_{B1}$ produces an error $V_{Berror}$ in the voltage $V_B$, across the resistor $R_{B1}$. This can be compensated by a similar error of opposite effect on $V_{SBG}$ in the voltage across the resistor $R_{BC}$ by choosing $R_{BC}=R_{B1}$. This works because $R_{B2}/R_{B1}>5$ The resistors $R_{P1}$, $R_{P2}$ and $R_{PC}$ are omitted, as their function is fulfilled by the resistor $R_{N3}$, and as $R_{P1}$ and $R_{P2}$ are removed the base currents of the transistors $Q_4$ and $Q_2$ do not generate error. The emitter currents $I_3$ and $I_1$ of the transistors $Q_3$ and $Q_1$ are arranged to be equal and their ratio does not vary with temperature. Adjustment of curvature compensation can be obtained, for example by replacing the resistors 360 and 362 by current sources providing adjustable variation with temperature of the ratio of the collector currents of the transistors $Q_4$ and $Q_2$.

The driver 354 in FIG. 8 may be the same as that shown in FIG. 3 or may be another suitable driver.

While the rail 104 has been described as being at ground potential, it will be appreciated that its potential need not be 0 volts but it may be a virtual ground at any suitable potential.

In the foregoing specification, the invention has been described with reference to specific examples of embodiments of the invention. It will, however, be evident that various modifications and changes may be made therein without departing from the broader spirit and scope of the invention as set forth in the appended claims. For example, the connections may be any type of connection suitable to transfer signals from or to the respective nodes, units or devices, for example via intermediate devices. Accordingly, unless implied or stated otherwise the connections may for example be direct connections or indirect connections.

Where the context admits, it will be understood that the semiconductor substrate described herein can be any semiconductor material or combinations of materials, such as gallium arsenide, silicon germanium, silicon-on-insulator (SOI), silicon, monocrystalline silicon, the like, and combinations of the above.

Where the apparatus implementing the present invention is composed of electronic components and circuits known to those skilled in the art, circuit details have not been explained to any greater extent than that considered necessary for the understanding and appreciation of the underlying concepts of the present invention.

Where the context admits, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Where the context admits, illustrated hardware elements may be circuitry located on a single integrated circuit or within a same device or may include a plurality of separate integrated circuits or separate devices interconnected with each other. Also, hardware elements in an embodiment of the invention may be replaced by software or code representations in an embodiment of the invention.

Furthermore, it will be appreciated that boundaries described and shown between the functionality of circuit elements and/or operations in an embodiment of the invention are merely illustrative. The functionality of multiple operations may be combined into a single operation, and/or the functionality of a single operation may be distributed in additional operations. Moreover, alternative embodiments may include multiple instances of a particular operation, and the order of operations may be altered in various other embodiments.

In the claims, any reference signs placed between parentheses shall not be construed as limiting the claim. Where the context admits, terms such as "first" and "second" are used to distinguish arbitrarily between the elements such terms describe and these terms are not necessarily intended to indicate temporal or other prioritization of such elements.

The invention claimed is:

1. A complementary band-gap voltage reference circuit comprising:

first and second groups of transistors, wherein each group comprises at least one transistor of npn type and at least one transistor of pnp type and the transistors of different types in the same group having different smaller or bigger emitter current conduction areas;

emitter-collector paths of a first transistor of each of said first and second groups being connected in parallel from a common connection so as to present differential base-emitter voltages across said first transistors, wherein said first transistors having a same first type and different emitter current conduction areas;

a second transistor of each of said first and second groups being connected with its emitter-collector path in parallel with a base-emitter junction of said first transistor of the same group so as to present differential base-emitter voltages of said second transistors across said first and second groups of transistors, wherein said second transistors having the same type and different emitter current conduction areas; and output terminals connected to receive a regulated voltage which is an additive function of said differential base-emitter voltages and of additive base-emitter voltages of transistors with smaller emitter current conduction area and different type.

2. A complementary band-gap voltage reference circuit as claimed in claim 1, wherein said transistors of additive base-emitter voltages are transistors of said first and second groups.

3. A complementary band-gap voltage reference circuit as claimed in claim 2, wherein voltage is regulated at said output terminals, by coupling said output terminals to receive current from a supply through a driver responsive to a differential voltage across said first transistors.

4. A complementary band-gap voltage reference circuit as claimed in claim 1, wherein said regulated voltage comprises:

an additive function of a voltage which is proportional to the base-emitter voltage of a transistor of said first group with smaller emitter current conduction area, a voltage which is proportional to the base-emitter voltage of a transistor of said second group with smaller emitter current conduction area, and of said differential base-emitter voltages.

5. A complementary band-gap voltage reference circuit as claimed in claim 4, wherein voltage is regulated at said output terminals, by coupling said output terminals to receive current from a supply through a driver responsive to a differential voltage across said first transistors.

6. A complementary band-gap voltage reference circuit as claimed in claim 1, wherein said transistors of additive base-emitter voltages comprise:

further transistors whose emitter-collector paths are connected in parallel with emitter-collector paths of said first and second groups.

7. A complementary band-gap voltage reference circuit as claimed in claim 6, wherein said further transistors have smaller emitter current conduction areas.

8. A complementary band-gap voltage reference circuit as claimed in claim 7, wherein apart from base current compensation, said regulated voltage is arranged to be proportional to $$V_{SBG}=V_{RN1}+\Delta Vbe_N+\Delta Vbe_P,$$

$V_{RN1}$ is proportional to an additive function of said base-emitter voltages of said further transistors of said first and second groups with smaller emitter current conduction areas, and $\Delta Vbe_N$ and $\Delta Vbe_P$ are proportional to said differential base-emitter voltages of said first transistors and of said second transistors of said first and second groups.

9. A complementary band-gap voltage reference circuit as claimed in claim 6, wherein apart from base current compensation, said regulated voltage is arranged to be proportional to $$V_{SBG}=V_{RN1}+\Delta Vbe_N+\Delta Vbe_P,$$

$V_{RN1}$ is proportional to an additive function of said base-emitter voltages of said further transistors of said first and second groups with smaller emitter current conduction areas, and $\Delta AVbe_N$ and $\Delta Vbe_P$ are proportional to said differential base-emitter voltages of said first transistors and of said second transistors of said first and second groups.

10. A complementary band-gap voltage reference circuit as claimed in claim 1, wherein voltage is regulated at said output terminals, by coupling said output terminals to receive current from a supply through a driver responsive to a differential voltage across said first transistors.

11. A complementary band-gap voltage reference circuit as claimed in claim 1, wherein said transistors are bipolar transistors.

12. A complementary band-gap voltage reference circuit as claimed in claim 1, wherein base current compensation is obtained by including resistors in the base current paths of similar value but of opposite effect on said regulated voltage.

13. A complementary band-gap voltage reference circuit comprising:

first and second groups of transistors, wherein each group comprises at least a first transistor of npn type and at least a second transistor of pnp type, the transistors of different types in the same group having different smaller or bigger emitter current conduction areas, emitter-collector paths of said second transistor of each of said first and second groups being connected in parallel from a common connection so as to present differential base-emitter voltages across said second transistors, said second transistors having different emitter current conduction areas, and said first transistor of each of said first and second groups being connected with its emitter-collector path in parallel with a base-emitter junction of said second transistor of the same group so as to present differential base-emitter voltages of said first transistors across said first and second groups of transistors, said first transistors having different emitter current conduction areas, and output terminals connected to receive a regulated voltage which is an additive function of said differential base-emitter voltages and of additive base-emitter voltages of transistors with smaller emitter current conduction area and different type.

14. A complementary band-gap voltage reference circuit as claimed in claim 13, wherein said transistors of additive base-emitter voltages comprise transistors of said first and second groups.

15. A complementary band-gap voltage reference circuit as claimed in claim 13, wherein said transistors of additive base-emitter voltages comprise further transistors whose emitter-collector paths are connected in parallel with emitter-collector paths of said first and second groups.

16. A complementary band-gap voltage reference circuit as claimed in claim 15, wherein apart from base current compensation, said regulated voltage is arranged to be proportional to $$V_{SBG}=V_{RN1}+\Delta Vbe_N+\Delta Vbe_P,$$

$V_{RN1}$ is proportional to an additive function of said base-emitter voltages of said further transistors of said first and second groups with smaller emitter current conduction areas, and $\Delta Vbe_N$ and $\Delta Vbe_P$ are proportional to said differential base-emitter voltages of said first transistors and of said second transistors of said first and second groups.

17. A complementary band-gap voltage reference circuit as claimed in claim 15, wherein said further transistors have smaller emitter current conduction areas.

18. A complementary band-gap voltage reference circuit as claimed in claim 17, wherein apart from base current compensation, said regulated voltage is arranged to be proportional to $$V_{SBG}V_{RN1}+\Delta Vbe_N+\Delta Vbe_P,$$

$V_{RN1}$ is proportional to an additive function of said base-emitter voltages of said further transistors of said first and second groups with smaller emitter current conduction areas, and $\Delta Vbe_N$ and $\Delta Vbe_P$ are proportional to said differential base-emitter voltages of said first transistors and of said second transistors of said first and second groups.

19. A complementary band-gap voltage reference circuit as claimed in claim 13, wherein base current compensation is obtained by including resistors in the base current paths of similar value but of opposite effect on said regulated voltage.

20. A complementary band-gap voltage reference circuit as claimed in claim 13, wherein said transistors are bipolar transistors.

* * * * *